United States Patent [19]

Martell et al.

[11] Patent Number: 4,565,140

[45] Date of Patent: Jan. 21, 1986

[54] METHOD AND APPARATUS FOR AUTOMATICALLY ADJUSTING THE SENSITIVITY OF EDGE SENSORS IN A SEMI-AUTOMATIC SEWING MACHINE

[75] Inventors: Charles R. Martell; Donald D. Isett, both of Dallas; Stephen S. Treadwell, Richardson, all of Tex.

[73] Assignee: Microdynamics, Inc., Dallas, Tex.

[21] Appl. No.: 577,579

[22] Filed: Feb. 6, 1984

[51] Int. Cl.[4] ..... D05B 19/00

[52] U.S. Cl. ..... 112/121.11; 112/262.1; 112/272; 112/275

[58] Field of Search ..... 112/121.11, 272, 275, 112/277, 121.12, 262.1, 158 E; 356/91, 429; 250/561, 571, 559; 271/258, 260

[56] References Cited

U.S. PATENT DOCUMENTS 4,403,558 9/1983 Martell et al. ..... 112/121.11
4,404,919 9/1983 Martell et al. ..... 112/272 X
4,487,502 12/1984 Fantozzi et al. ..... 356/51 X

*Primary Examiner*—Peter Nerbun
*Attorney, Agent, or Firm*—Jerry W. Mills; Gregory M. Howison

[57] ABSTRACT

An adaptive semi-automatic sewing system (10) comprises a sewing machine (12), a drive unit (42) including a variable speed motor and encoder for counting stitches sewn and for sensing the rotation of the motor, at least one material edge sensor (40*a*) mounted ahead of the needle (22) of the sewing machine, and a microprocessor controller (51) coupled to the sewing machine controls. Accurate control of seam lengths and end points is achieved by initiating countdown of a variable number of final stitches responsive to detection of the material edge by the sensors (40*a*). The system includes controls (98) coupled to microprocessor controller (51) for dynamically adjusting the sensitivity of the sensors (40*a*) for variances in the materials being sewn.

9 Claims, 6 Drawing Figures

FIG. 1
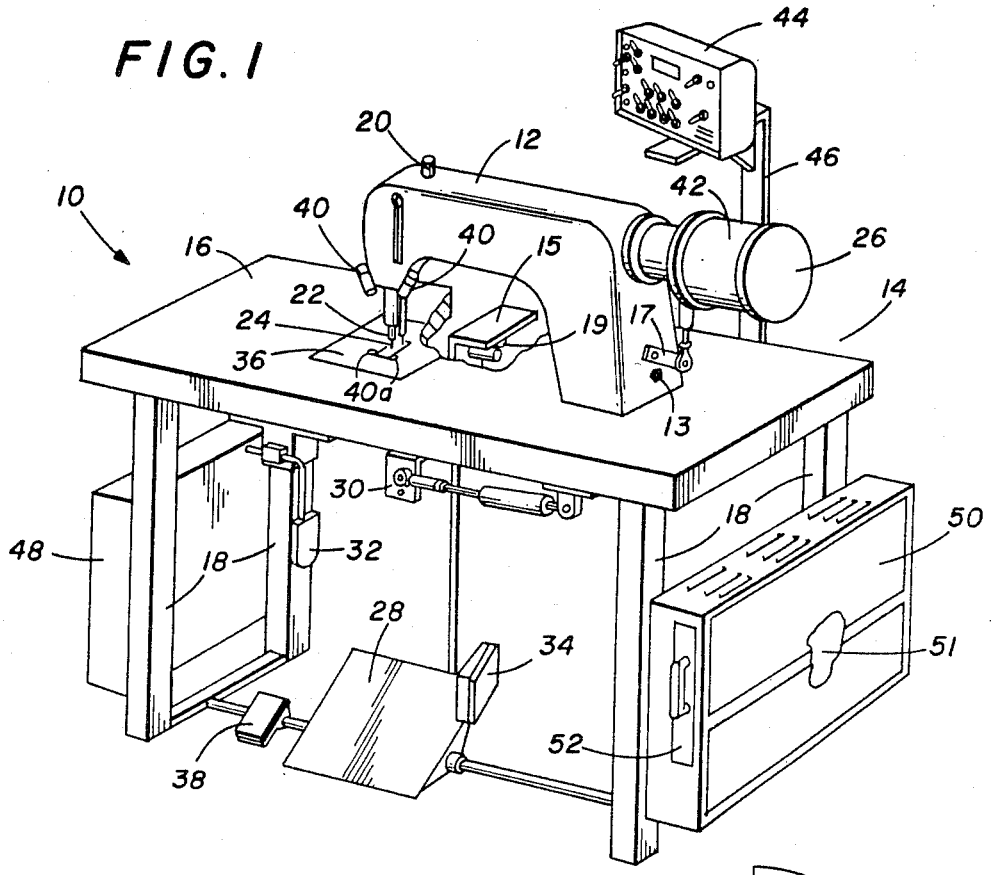
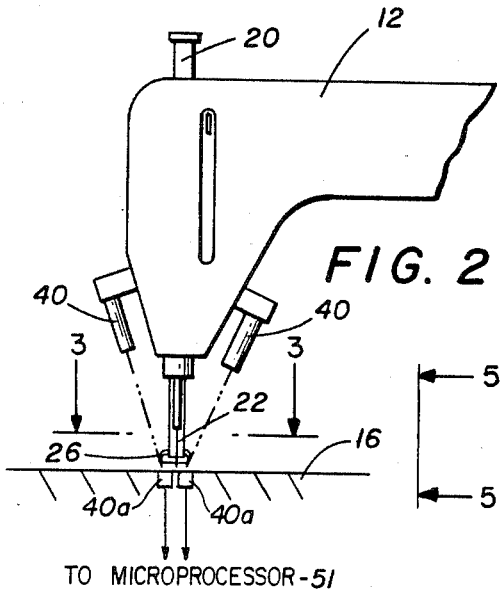
FIG. 2
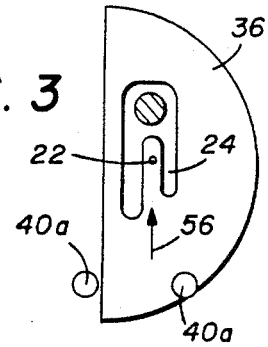
FIG. 3

FIG. 4
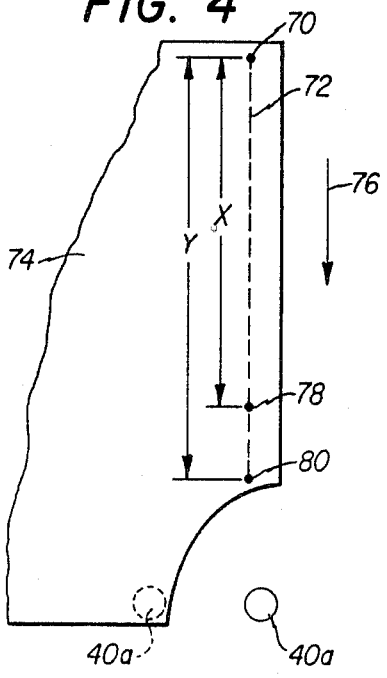
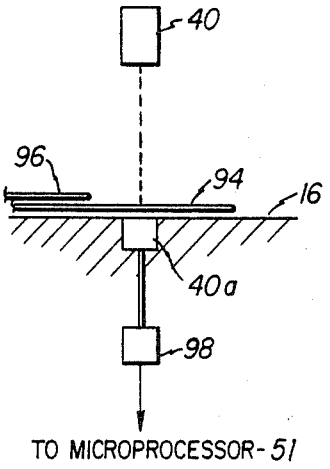
FIG. 5
FIG. 6
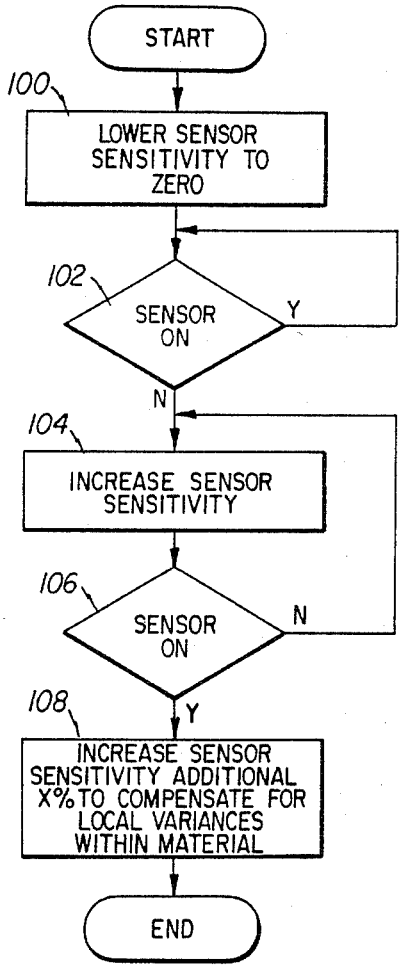

METHOD AND APPARATUS FOR AUTOMATICALLY ADJUSTING THE SENSITIVITY OF EDGE SENSORS IN A SEMI-AUTOMATIC SEWING MACHINE

TECHNICAL FIELD

The present invention relates generally to a control system to adapt a sewing machine for semi-automatic operation. More particularly, this invention is directed to an adaptive sewing machine control system incorporating a microprocessor controller in combination with a stitch counter, an edge sensor and stitch length control apparatus to achieve more precise seam lengths and end points.

BACKGROUND OF THE INVENTION

In the sewn goods industry, where various sections of material are sewn together to fabricate products, reasonably precise seam lengths and end points are often necessary for proper appearance and function of the finished products. For example, the top stitch seam of a shirt collar must closely follow the contour of the collar and terminate at a precise point which matches the opposite collar. Accurate seam lengths must similarly be maintained in the construction of shoes when sewing together vamps and quarter pieces to achieve strength as well as pleasing appearance. Achieving consistently accurate seam lengths and end points at high rates of production has, however, been a long standing problem in the industry.

Microprocessor controllers have been developed which convert manually operated sewing machines into semi-automatic sewing systems. U.S. Pat. Nos. 4,108,090; 4,104,976; 4,100,865; and 4,092,937, assigned to the Singer Company are representative of such devices. Each of those patents discloses a programmable sewing machine with three operational modes: manual, teach and auto. Control parameters are programmed into the system for subsequent control of the sewing machine in the auto mode. Those microprocessors control all sewing machine functions such as sewing speed, presser foot position, thread trimmer, reverse sew mechanism and the number of stitches sewn in each individual seam. They thus offer higher speeds of operation and consequently higher rates of productivity than do manually operated sewing machines. Accurate control of seam lengths is one of the important aspects of those systems.

U.S. Pat. No. 4,404,919, issued Sept. 20, 1983, entitled "Control System for Providing Stitch Length Control of a Sewing Machine", and assigned to assignor describes a microprocessor controlled sewing system which improves upon the seam length accuracy of those systems. The system disclosed in U.S. Pat. No. 4,404,919 controls seam length accuracy using a combination of stitch counting, edge detection and stitch length control techniques. Control of seam lengths and end points is achieved in the system by initiating countdown of a variable number of final whole and partial stitches responsive to detection of the edge of the material being sewn by sensors located ahead of the needle. In dependence upon the amount of the stitch which has been sewn upon edge detection by the sensors, the microprocessor issues a signal to position the reverse sew mechanism of the sewing machine while the last stitch is being formed to reduce the length of the last stitch to a desired percentage of the normal stitch length and thus improves the accuracy of the seam end point.

An important feature of the disclosed system is the ability of the sensors to detect the presense of material being sewn and to signal the approach of the seam end. The sensors are used as external edge sensors to control the end of the seam by detecting the presence or absence of material at the boundary of the bottom ply of material being sew, as when sewing a collar seam. Alternatively, the sensors may be used as internal edge sensors to detect the difference between "N" plies and "N+M" plies of material, as when sewing a patch pocket onto the front panel of a shirt or a pants panel. In the latter example, the sensors signal the end of a pocket seam by detecting the difference between two plies of material, i.e., the pocket and the panel on which it is being sewn, and the single ply of material forming the panel.

Prior microprocessor controller systems have commonly used manually variable sensitivity sensors as internal edge detectors. When such sensors are used, the sensitivity of the sensor must be manually adjusted to ensure that the sensor detects the boundary of the relevant ply of material. In a commercial environment where a wide variety of materials are sewn in a single bundle of production work, the sewing machine operator using such prior systems must frequently readjust the sensitivity of the sensor to compensate for material variances, such as thickness, color, construction and finish and for the number of plies of material being sewn. The time required for such sensor sensitivity adjustment reduces the operator's production rate and the benefits attendant with use of microprocessor controlled systems.

A need has thus arisen for an improved adaptive sewing machine control system which includes automatic means for dynamically adjusting the sensitivity of the edge sensors to compensate for material variances to thus obtain more accurate seam lengths and end points.

SUMMARY OF INVENTION

The present invention comprises an adaptive sewing machine control system which substantially improves upon prior microprocessor controlled systems by providing automatic means for adjusting edge sensor sensitivity.

In accordance with the invention, there is provided a system including a microprocessor controller which can be programmed with or taught a sequence of sewing operations by the operator in one mode for automatically controlling the machine during subsequent sewing of similar pieces of the same or different sizes in another mode. The semi-automatic system uses a combination of stitch counting and automatically variable material edge detection techniques together with techniques for varying the length of the last stitch sewn to achieve more accurate seam length and end point control.

More specifically, this invention comprises a microprocessor-based control system for an industrial sewing machine. The system has manual, teach and auto modes of operation. In the preferred embodiment, one or more sensors are mounted in front of the presser foot for monitoring edge conditions of the material at the end of each seam. In the teach mode, operating parameters are programmed into the controller by the operator. For each seam, the number of whole and partial stitches x sewn after the desired status change in the sensors are recorded along with sewing machine and auxiliary control inputs. In the auto mode, the number of stitches sewn in each seam is monitored until the characteristic sensor pattern indicating edge detection is seen, at which time x additional stitches are sewn to complete the seam. The system also includes controls coupled to the microprocessor controller for dynamically adjusting the sensitivity of the edge sensors to account for variances in the materials being sewn to thus ensure that the sensors properly sense the approach of the end of the seam without the need for human intervention.

BRIEF DESCRIPTION OF DRAWINGS

A more complete understanding of the invention can be had by reference to the following detailed description taken in conjunction with the accompanying Drawings, in which:

FIG. 1 is a perspective view of a programmable sewing system incorporating the invention;

FIG. 2 is a front view illustrating placement of the edge sensor relative to the sewing needle;

FIG. 3 is a sectional view taken along lines 3—3 of FIG. 2 in the direction of the arrows;

FIG. 4 is an illustration of a seam being provided in a piece of material by means of the present invention;

FIG. 5 is a sectional view taken along lines 5—5 of FIG. 2 in the direction of the arrows; and FIG. 6 is a flowchart of the control logic of the present invention to dynamically adjust the sensitivity of the edge detection sensor.

DETAILED DESCRIPTION OF THE INVENTION

Referring now to the Drawings, wherein like reference numerals designate like or corresponding parts throughout, FIG. 1 illustrates a semi-automatic sewing system 10 incorporating the invention. System 10 is a microprocessor-based system adapted to extend the capabilities of a sewing machine to enable the operator to perform sewing procedures on a manual or semi-automatic basis.

System 10 includes a conventional sewing machine 12 mounted on a work stand 14 consisting of a table top 16 supported by four legs 18. Sewing machine 12, which is of conventional construction, includes a spool 20 containing a supply of thread for stitching by a reciprocable needle 22 to form a seam in one or more pieces of material. Surrounding needle 22 is a vertically movable presser foot 24 for cooperation with movable feed dogs (not shown) positioned within table top 16 for feeding material past the needle.

A number of standard controls are associated with sewing machine 12 for use by the operator in controlling its functions. A handwheel 26 is attached to the drive shaft (not shown) of machine 12 for manually positioning needle 22 in the desired vertical position. Sewing speed is controlled by a speed sensor 15 which is actuated by a foot treadle 28, which functions as an accelerator. Vertical positioning of pressor foot 24 can be controlled by heel pressure on foot treadle 28 which closes a switch 19 in speed sensor 15, which in turn causes the presser foot lift actuator 30 to operate. A leg switch 32 is provided for controlling the sewing direction of machine 12 by causing operation of a reverse sew mechanism 17. A toe switch 34 located adjacent to foot treadle 28 controls a conventional thread trimmer (not shown) disposed underneath the throat plate 36 of machine 12. Foot switch 38 on the other side of foot treadle 28 comprises a one-stitch switch for directing machine 12 to sew a single stitch.

Sewing machine 12 and its associated manual controls are of substantially conventional construction, and may be obtained from several commercial sources, e.g., Singer, Union Special, Pfaff, Consew, Juki, Columbia, Brother or Durkopp Companies.

In addition to the basic sewing machine 12 and its manual controls, system 10 includes several components for adapting the sewing machine for semi-automatic operation. One or more sensors **40*a* are mounted in laterally spaced-apart relationship in front of needle 22 and presser foot 24 and are operative to signal the approach of the end of the seam by detecting a material discontinuity or the trailing edge of the material being sewn. When internal edge sensing is required, the sensors 40*a* are infrared sensors which sense infrared light emitted by one or more lamps 40 which are mounted on the main body of the sewing machine 12. A drive unit 42 comprising a variable speed direct drive motor, sensors for stitch counting and an electromagnetic brake for positioning of needle 22, is attached to the drive shaft of sewing machine 12. A main control panel 44 supported on a bracket 46 is provided above one corner of work stand 14. A pneumatic control chassis 48 containing an air regulator, filter and lubricator for the sewing machine control sensors, pneumatic actuators and other elements of system 10 is provided on one side of work stand 14**. All of these components are of known construction and are similar to those shown in U.S. Pat. Nos. 4,108,090; 4,104,976; 4,100,865 and 4,092,937, the disclosures of which are incorporated herein by reference.

A controller chassis 50 is located on the opposite side of work stand 14 for housing the electronic components of system 10. Chassis 50 includes a microprocessor controller 51, appropriate circuitry for receiving signals from sensors and carrying control signals to actuators, and a power module for providing electrical power at the proper voltage levels to the various elements of system 10. The microprocessor controller 51 may comprise a Zilog Model Z-80 microprocessor or any suitable unit having a read only memory (ROM) and random access memory (RAM) of adequate storage capacities. An auxiliary control panel 52 is mounted for sliding movement in one end of chassis 50.

Circuitry is provided in chassis 50 which detects the output of sensors **40*a* to generate electrical signals representative of the material edge. Controller 51** is responsive to such edge detection for allowing a selected number of stitches to be sewn after the edge detection.

The present system may first be programmed in a teach mode and thereafter operated in an auto mode. The system may be taught in the teach mode to sew x stitches after the material edge is detected where x is a combination of whole and partial stitches. Thereafter, when the system is operated in the auto mode, the edge of the material will be automatically detected by the sensor and the machine will then automatically sew x stitches before terminating the seam. In this manner, automatic operation of the system is provided to increase the speed and accuracy of the system without human intervention. The present system operates in essentially the same manner as the system described in U.S. Pat. No. 4,404,919, the disclosure of which is incorporated herein by reference, with additional improvement and accuracy being provided by the present invention as will be subsequently described.

Referring to FIGS. 2 and 3, further details of edge sensors 40*a* and their cooperation with needle 22 can be seen. Sensor lamps 40 may be mounted directly on the housing of sewing machine 12, or supported by other suitable means. The lamps 40 project infrared light onto sensors 40*a*. The status of each sensor 40*a* is either "on" or "off" depending upon whether or not the infrared light is detected. The amount of light which must be detected to turn "on" the sensor 40*a* is varied by a sensitivity adjustment circuit incorporated in chassis 50.

Sensors 40*a* are positioned in mutually spaced relationship ahead of needle 22 of sewing machine 12. The condition of at least one sensor 40*a* changes as the trailing material edge passes thereover to indicate approach of the seam end point. Sensors such as the Honeywell Model SPX7292-1 have been found satisfactory for use as sensors 40*a*.

Sensors 40*a* operate as either external edge detectors where the seam end approaches the boundary of the bottom ply of material being sewn or as internal edge detectors where the seam end does not approach the boundary of the bottom ply of material. In the former instance, sensors 40*a* thus signal the end of the seam by detecting the presence or absence of material. The operation and function of sensors 40*a* as external edge detectors will be better understood with reference to FIG. 4. Beginning at start point 70, as a seam 72 is sewn by sewing machine 12 (not shown) along a piece of material 74 in the direction of arrow 76, the number of stitches from start point 70 are counted by the encoder within drive unit 42. The sensors 40*a* are initially covered by material 74, and the infrared light of lamps 40 is blocked by material 74, thus maintaining sensors 40*a* in an "off" state. At point 78 when the edge of material 74 moves past one sensor 40*a*, that sensor turns "on", to thus indicate the approach of the end of the seam. Thereafter "y-x" stitches are sewn to complete the seam.

When used as an internal edge detector, the sensitivity level of sensor 40*a* is adjusted in accordance with the physical characteristics of the material being sewn and the number of plies of material being sewn to ensure proper detection of the seam end.

FIG. 5 is a sectional view showing how the edge sensor is used as an internal edge detector. The amount of infrared light required to switch sensors 40*a* from "off" to "on" can be varied by means of a sensitivity adjustment circuit 98.

When sensor 40*a* is used to detect an internal edge, the sensor sensitivity must be adjusted such that the infrared light which passes through one ply of material is sufficient to turn "on" the sensor, while the light that passes through two plies of material does not turn "on" the sensor. The sensor 40*a* would thus be in an "off" state when sewing two plies of material 94 and 96 and wound turn "on" to signal the approach of the trailing edge of the top ply once the top ply 96 moved past the sensor.

Previously, adjustment of such sensor sensitivity was performed manually. The present system improves upon the operation of those prior sewing machine control systems by including controls for automatically adjusting the sensitivity of the edge sensors to compensate for material variances, such as thickness, construction, finish and color and for the number of plies of material being sewn. The controls are illustrated as block 98 in FIG. 5 and may comprise a servomotor to dynamically adjust the resistance value of the sensor circuit to require different light levels to switch the sensor. The servomotor is adjusted by signals from microprocessor 51.

FIG. 6 is a flowchart of the control logic of the present invention for dynamically adjusting sensor sensitivity and can best be understood with reference to the patch pocket sewing operation. Microprocessor controller 51 at 100 operates the sensor controls to lower the sensor sensitivity to "zero" by, for example, adjusting the resistivity level of the sensor circuit to its lowest setting. When the sensitivity is set to the "zero" level, the sensor will switch "on" only when there is no material present between the sensor 40*a* and lamp 40. When the operator thereafter places a shirt or pants panel on which a pocket is to be sewn under the needle, the sensor is blocked and because its sensitivity is at a zero level, the sensor changes from an "on" state to an "off" state at 102. Microprocessor controller 51 then operates the controls 98 to increase the sensor sensitivity, at 104 until the sensor detects the infrared light which penetrates the one ply of material, i.e., the sensor turn "on", at 106. The controls 98 are thereafter operated at 108 to increase the sensor sensitivity an additional predetermined amount to compensate for local variances in the material. When the pocket is thereafter placed on top of the panel, the sensor turns "off". Because the sensor sensitivity has been adjusted to penetrate one ply of material only, the sensor will thereafter properly detect the boundary of the pocket and will turn "on" to signal the approach of the end of the seam once the trailing edge of the pocket moves past the sensor.

Because the system thus automatically adjusts the sensitivity during the time interval between placing the panel over the sensor and placing the pocket on the panel, the need for operator intervention is eliminated and the productivity and flexibility of the system improved.

An alternate method of compensating for material variances is to vary the output of lamp 40 while holding the sensitivity of sensor 40*a* constant. This technique is implemented by using controls 98 to vary the voltage of the circuit which powers lamp 40. In this implementation, the lamp intensity would be dropped to zero and then increased by controls 98 until sensor 40*a* turns "on". At that point, the intensity would be increased an additional predetermined amount to compensate for local variance in the material.

A second alternate method would be to electronically alter the sensitivity of the sensor circuit to adjust the sensor sensitivity. If desired, this and the other implementations could function independent of the microprocessor by adding the appropriate control circuitry.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. In a sewing machine having a reciprocable needle for stitching seams in material advanced in a feed direction, seam length control apparatus comprising:

means having variable sensitivity for detecting a material discontinuity in advance of a seam;

means for controlling an operation of the sewing machine in response to detection of said material discontinuity by said detecting means; and means for automatically adjusting the sensitivity of said detecting means to compensate for variances in the material being sewn.

2. The sewing machine of claim 1 wherein said adjusting means adjusts the sensitivity of said detecting means to further compensate for the number of plies of the material being sewn.

3. The sewing machine of claim 1 wherein said detecting means comprises at least one on/off sensor mounted ahead of said needle in a direction opposite the material feed direction.

4. The sewing machine of claim 3 wherein said sensor comprises an infrared emitter and an infrared sensor mounted in vertically spaced relationship.

5. The sewing machine of claim 4 wherein said adjusting means adjusts the sensitivity of said sensor by varying the light level required to switch said infrared sensor.

6. The sewing machine of claim 4 wherein said adjusting means adjusts the sensitivity of said sensor by varying the output of said infrared emitter.

7. The sewing machine of claim 1 wherein the operation of the sewing machine comprises sewing a predetermined number of stitches after detection of said material discontinuity.

8. In a sewing machine having a reciprocable needle for stitching seams in material advanced in a feed direction, seam length control apparatus comprising:

at least one variable sensitivity on/off sensor mounted ahead of said needle in a direction opposite the material feed direction for detecting a material discontinuity in advance of a seam;

a microprocessor controller responsive to said sensor to operate said reciprocable needle to sew a number of stitches after said sensor detects said material discontinuity;

said microprocessor controller being further operative to automatically adjust the sensitivity of said sensor to compensate for the number of plies of material being sewn.

9. The sewing machine of claim 8 wherein said microprocessor controller adjusts the sensitivity of said sensor to further compensate for the physical characteristics of the material being sewn.

* * * * *